US006196913B1

(12) United States Patent
Geib et al.

(10) Patent No.: US 6,196,913 B1
(45) Date of Patent: Mar. 6, 2001

(54) CASH TILL MANIFOLD HAVING A SIXTH COIN BIN FOR A COIN SORTER

(75) Inventors: Joseph J. Geib, Mt. Prospect; Steven S. Kuhlin, Lake Zurich, both of IL (US)

(73) Assignee: Cummins-Allison Corp., Mount Prospect, IL (US)

( * ) Notice: Subject to any disclaimer, the term of this patent is extended or adjusted under 35 U.S.C. 154(b) by 0 days.

(21) Appl. No.: 09/469,321

(22) Filed: Dec. 23, 1999

(51) Int. Cl.[7] ..... G07D 3/00; G07G 1/00
(52) U.S. Cl. ..... 453/10; 235/7 A
(58) Field of Search ..... 453/3–15; 235/7 R, 235/7 A, 10

(56) References Cited

U.S. PATENT DOCUMENTS

| | | | | |
|---|---|---|---|---|
| 470,812 | * | 3/1892 | McArthur | 453/5 |
| 3,026,982 | | 3/1962 | Buchholtz et al. | 194/9 |
| 4,059,122 | | 11/1977 | Kinoshita | 133/3 D |
| 4,172,462 | | 10/1979 | Uchida et al. | 133/3 A |
| 4,230,135 | | 10/1980 | Ueda | 133/3 D |
| 4,250,904 | | 2/1981 | Lueschen | 133/2 |
| 4,275,751 | | 6/1981 | Bergman | 133/3 C |
| 4,359,062 | | 11/1982 | Uecker et al. | 133/2 |
| 4,558,712 | * | 12/1985 | Sentoku et al. | 453/3 |
| 4,898,564 | | 2/1990 | Gunn et al. | 453/3 |
| 5,021,026 | | 6/1991 | Goi | 453/40 |
| 5,052,538 | | 10/1991 | Satoh | 194/317 |
| 5,059,153 | | 10/1991 | Goi | 453/11 |
| 5,154,272 | | 10/1992 | Nishiumi et al. | 194/318 |
| 5,183,142 | * | 2/1993 | Latchinian et al. | 194/206 |
| 5,366,407 | | 11/1994 | Sentoku | 453/3 |
| 5,443,419 | | 8/1995 | Adams et al. | 453/17 |
| 5,564,546 | | 10/1996 | Molbak et al. | 194/216 |
| 5,830,054 | * | 11/1998 | Petri | 453/5 |
| 5,989,118 | * | 11/1999 | Chiba et al. | 453/11 |
| 5,997,395 | | 12/1999 | Gieb et al. | 453/10 |

FOREIGN PATENT DOCUMENTS

| | | | |
|---|---|---|---|
| 1985-08 | 8/1985 | (CH) . | |
| 650871 A5 | 8/1985 | (CH) | G07D/3/00 |
| 129570 | 4/1902 | (DE) . | |
| 2515837 | 10/1975 | (DE) | G07D/3/16 |
| 2614560 | 10/1977 | (DE) . | |
| 3924199 A1 | 1/1990 | (DE) | G07D/1/00 |
| 2128795 | 5/1984 | (GB) | G07D/3/14 |

* cited by examiner

*Primary Examiner*—Robert P. Olszewski
*Assistant Examiner*—Bryan Jaketic
(74) *Attorney, Agent, or Firm*—Cummins-Allison Corp.; Stephen G. Rudisill

(57) ABSTRACT

A manifold adapted to distribute six coin denominations discharged from a coin sorter to a standard cash till is set forth. The manifold includes a plurality of paths to deliver at least five of the coin denominations to the five coin compartments of the standard cash till. The manifold delivers the sixth coin denomination to a receptacle within the manifold.

20 Claims, 13 Drawing Sheets

CASH TILL MANIFOLD HAVING A SIXTH COIN BIN FOR A COIN SORTER

FIELD OF THE INVENTION

The present invention relates generally to coin sorting devices and, more particularly, to a manifold for a coin sorter adapted to distribute coins into a cash till.

BACKGROUND OF THE INVENTION

Coin sorters have been used for a number of years. Coin sorters and counters have relieved those who deal with quantities of coins from the burden of manually processing, sorting, and/or counting coins. Banks, casinos, and retail stores are some of the beneficiaries of these machines. As business grow, these businesses are experiencing a greater number of customers resulting in an increased intake of coins. As would be expected, these businesses wish to process their coins as quickly and accurately as possible.

In the retail environment where cash registers are commonplace, it is customary for the cash register operator to periodically "count down" the cash till drawer of the cash register. Counting down is a process by which the operator determines the aggregate value of the coin and paper currency in the cash till. Typically, the currency is removed from the cash till and the operator counts the number of units of each currency denomination. Once the quantity of each currency denomination is determined, that quantity is placed back into its respective compartment within the cash till. Manually counting down the cash till often takes a significant amount of time and often involves mistakes, especially with counting the coins. These problems are further compounded when there is a large volume of currency to be counted or when there are several cash tills to be counted down. Once the operator has determined the quantity of each denomination of currency in the cash till, the aggregate value of that currency can be calculated. The aggregate value of money in the cash till is then compared to the receipts from the same cash register. When the receipts to not match the total amount of money in the cash till, the cash till must be recounted, thus taking up more time.

Cash tills typically contain five coin compartments. In the United States, cash register operators are forced to group the six coin denominations into the five coin compartments of the cash till. Unfortunately, prior art cash till manifolds route both the half-dollar and dollar coins back into the fifth compartment of the cash till. However, it is often desirable to segregate these coins rather than group them back together in the fifth compartment of the cash till. Thus, a need exists for a coin sorting/counting machine which quickly and accurately counts down the coins in a cash till and segregates all denominations of coins.

SUMMARY OF THE INVENTION

It is a primary object of this invention to provide a manifold for a coin sorter which is adapted to count down a cash till. In accordance with the present invention, the foregoing objective is realized by providing a coin sorter with a cash till manifold capable of distributing six denominations of coins. Coins from a cash till are deposited into a coin sorter. The coin sorter then sorts the coins by denomination and delivers the coins to the cash till manifold. The cash till manifold then distributes five coin denominations into the five coin compartments of the cash till, the sixth coin denomination is directed to a removable receptacle within the manifold.

BRIEF DESCRIPTION OF THE DRAWINGS

Other objects and advantages of the invention will become apparent upon reading the following detailed description and upon reference to the drawings in which.

DETAILED DESCRIPTION OF THE ILLUSTRATED EMBODIMENTS

Figure 1:
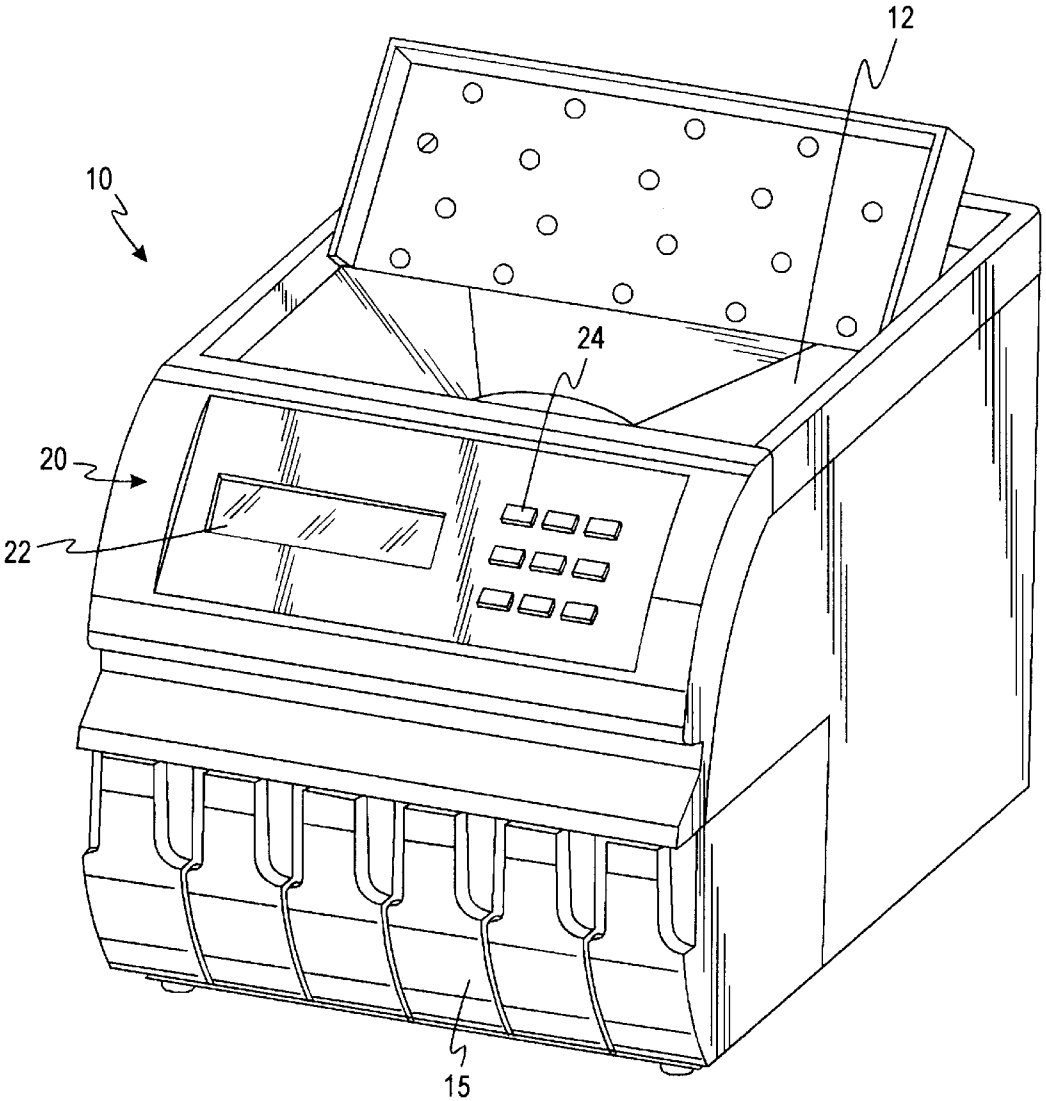
FIG. 1 (PRIOR ART)
FIG. 1 is a perspective view of a coin sorter system according to an embodiment of the invention disclosed in commonly-owned U.S. Pat. No. 5,997,395 entitled "High Speed Coin Sorter have a Reduced Size"

Referring first to FIG. 1, an embodiment of a coin sorter system 10 is illustrated. Such a coin sorter system is disclosed by commonly-owned U.S. Pat. No. 5,997,395 entitled "High Speed Coin Sorter Having a Reduced Size," which is incorporated herein by reference in its entirety. The coin sorter system 10 includes a coin tray 12 which receives coins of mixed denominations and feeds them into the coin sorting system 10. As the coins flow into the coin sorting system 10, they are deposited on the top surface of a rotatable disc (not shown). As the rotatable disc rotates, the coins deposited on the top surface of the disk tend to slide outwardly across the top surface of the rotatable disc due to the centrifugal force. As the coins move outwardly, those coins which are lying flat on the pad enter exit channels corresponding to the diameter of each coin. The sorted coins are captured in a plurality of coin bins 15 positioned on the exterior of the coin sorter system 10. One embodiment of the coin sorting system 10 contains six coin bins 15 located on the front of the coins sorter system 10. Such an embodiment may be used for sorting coin sets which have six different denominations of coins as in the United States or Canadian coin sets.

An operator control panel 20 is used by the operator to control the coin sorter system 10. The control panel 20 includes a display 22 for displaying information about the coin sorter system 10. The control panel 20 also includes keys 24 allowing the operator to enter information to the coin sorter system 10. In an alternative embodiment of the coin sorter system 10, the control panel 20 may also comprise a touch screen device which provides more versatility to the operator when inputting information to the coin sorter system 10. In another alternative embodiment of the coin sorter system 10, the display 22 and the keys 24 of the control panel 20 may be configured as illustrated in FIG. 2.

In an alternative embodiment of the coin sorting system 10, an operator may decide that the coin bins 15 are not needed and, instead, the sorted coins must be directed into the cash till of a typical cash register. Because the coins are sorted based on their diameters, not on their value, it is necessary to distribute the sorted coins into a pattern that coincides with the coin compartment locations in a cash till of a typical cash register. In the United States, the typical cash register has coin compartments in which coins are placed in a manner of increasing value. The typical cash till has only five coin compartments; yet, United States and Canadian currencies have six different coin denominations. Typically, cash register operators group two denominations of coins into a single compartment of the cash till drawer. For example, cash register operators in the United States often group the half-dollar and dollar coin into the same coin compartment. However, it is often preferable to segregate all six coin denominations.

Figure 2:
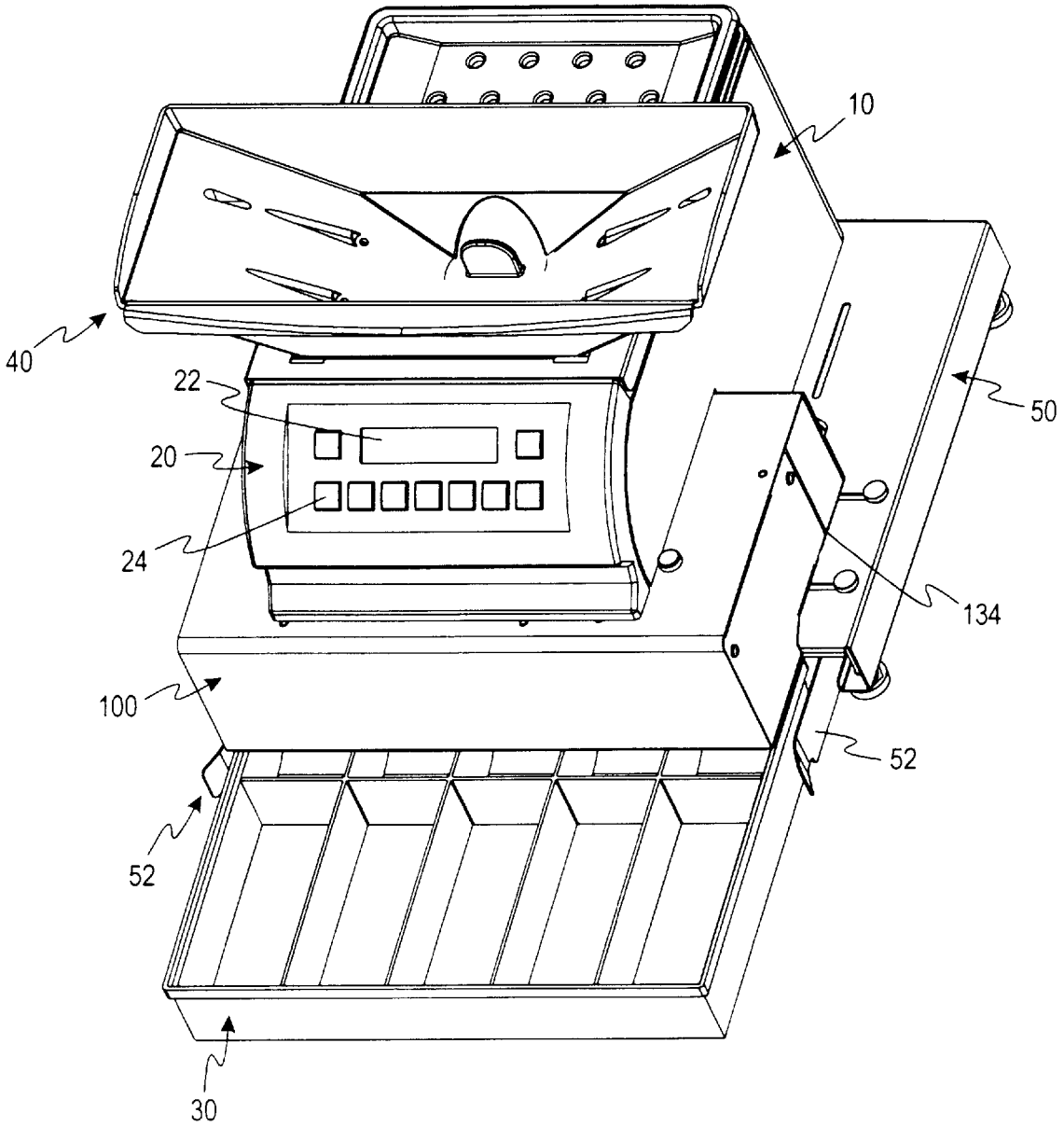
FIG. 2 is a perspective view of a coin sorter system according to an embodiment of the present invention.
Figure 3:
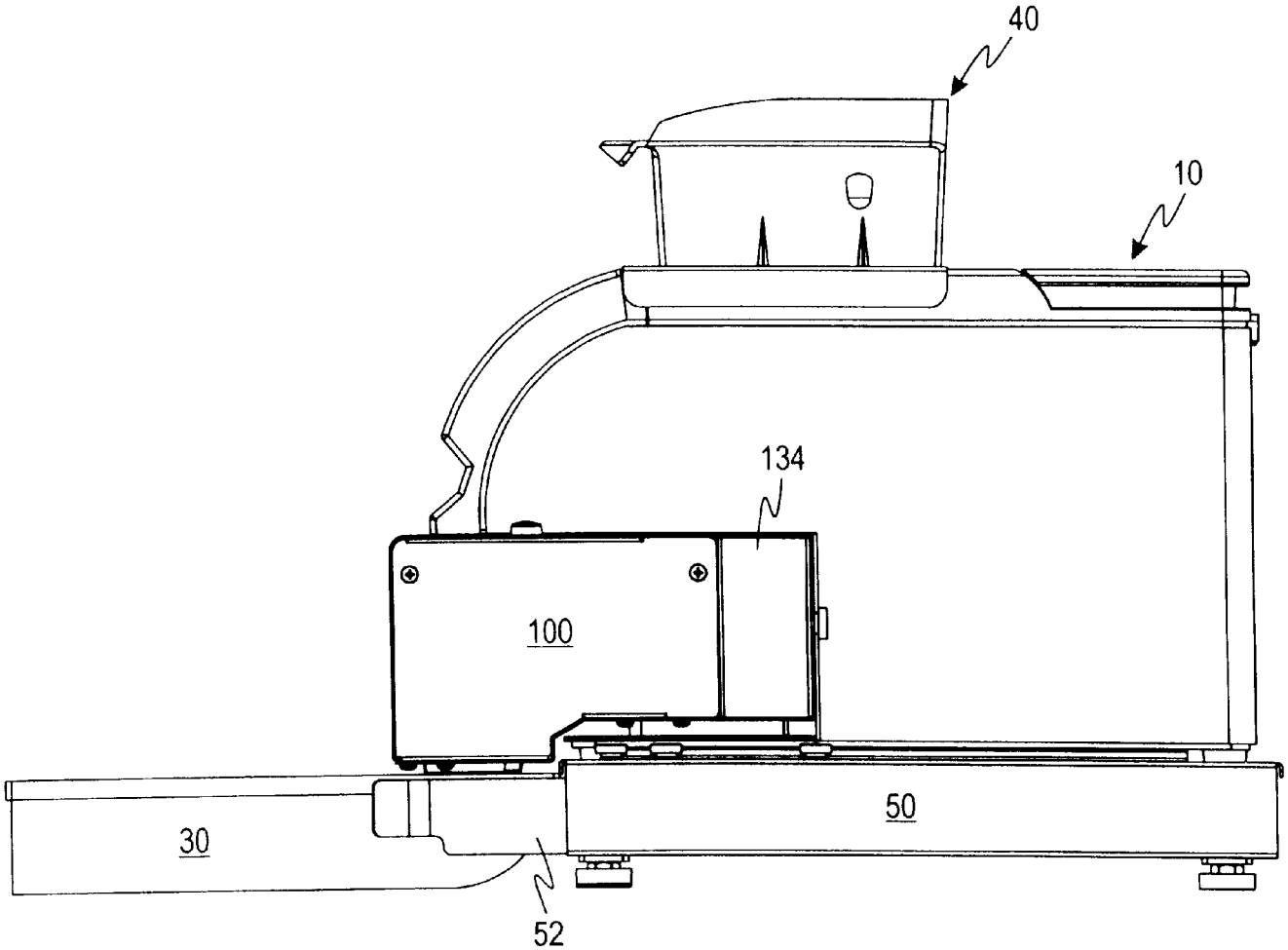
FIG. 3 is a side view of a coin sorter system according to an embodiment of the present invention.

To convert the coin sorter system 10 into a system which places coins into a till 30 of a standard retail cash register, the coin sorter system 10 includes a manifold 100 as shown in FIGS. 2–5. Referring specifically to FIGS. 2 and 3, because the coin sorter system 10 may have a width that is less than the typical cash till 30, the coin sorter system 10 may include a conversion device 40 over the coin tray. The conversion device 40 is wide enough to allow the operator to insert the cash till 30 and directly dump the coins from the till 30 into the coin sorter system 10 for processing without having to worry about the coins being spilled onto the floor. The conversion device 40 essentially funnels the coins into an lower aperture that is about as wide as the coin tray.

Because of the relatively compact size of the coin sorter system 10, it may be necessary to raise the coin sorter system 10 equipped with the manifold 100 off of the surface on which it rests with a structure 50. The structure 50 may also be designed to receive cash till 30 and align the respective compartments of the cash till beneath the corresponding outlets of the manifold 100. To aid in the quick alignment of the cash till 30, the structure 50 is equipped with guides 52. Additionally, raising the coin sorter system 10 allows a cash till 30 to be inserted in a reverse direction than what is shown in FIG. 2. This may be beneficial because some countries use coin tills which are arranged with the increasing value of coins going form right to left, not left to right.

Figure 4:
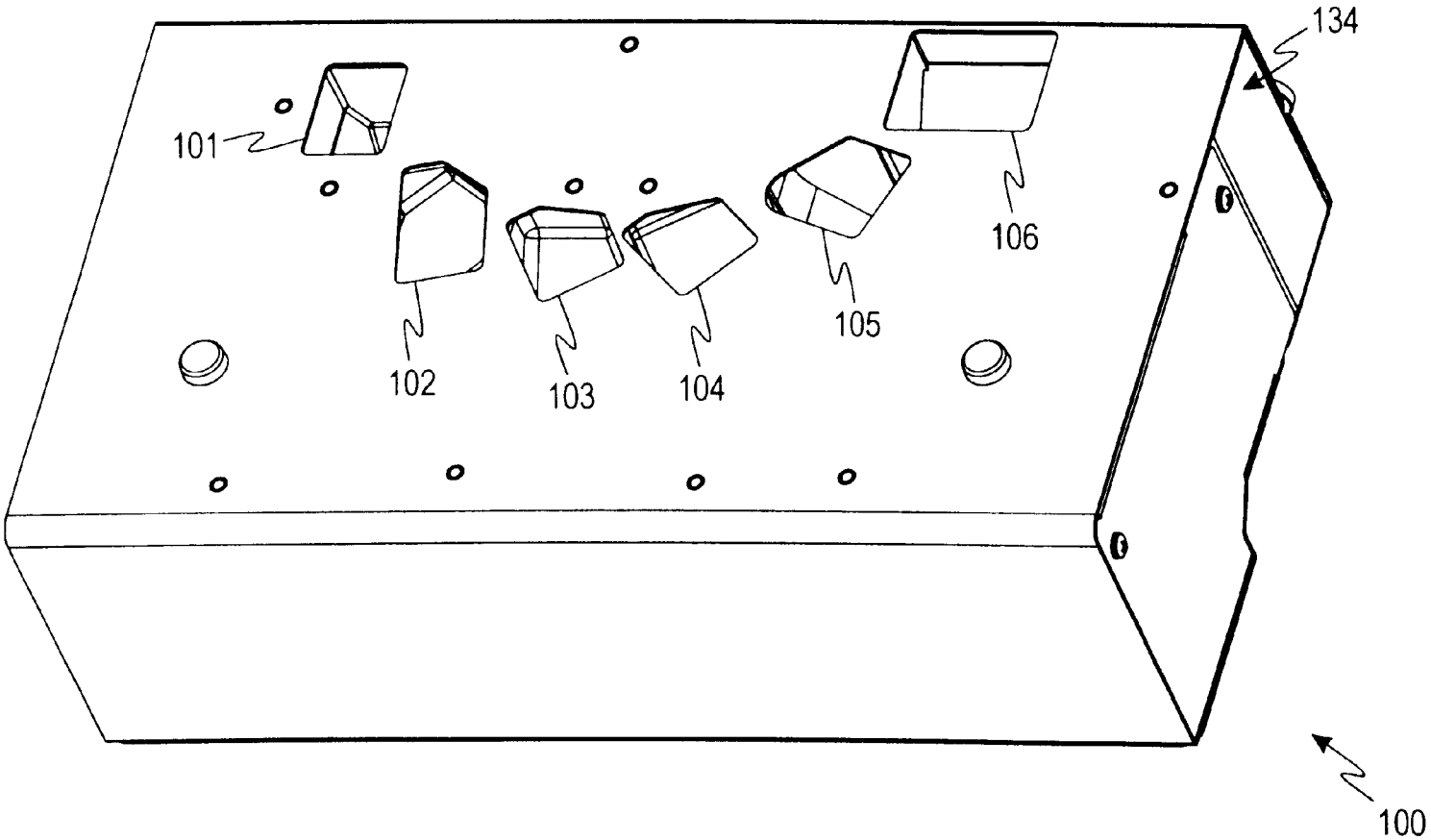
FIG. 4 is a perspective view of a cash till manifold having a sixth coin bin showing the inlets according to an embodiment of the present invention.
Figure 5:
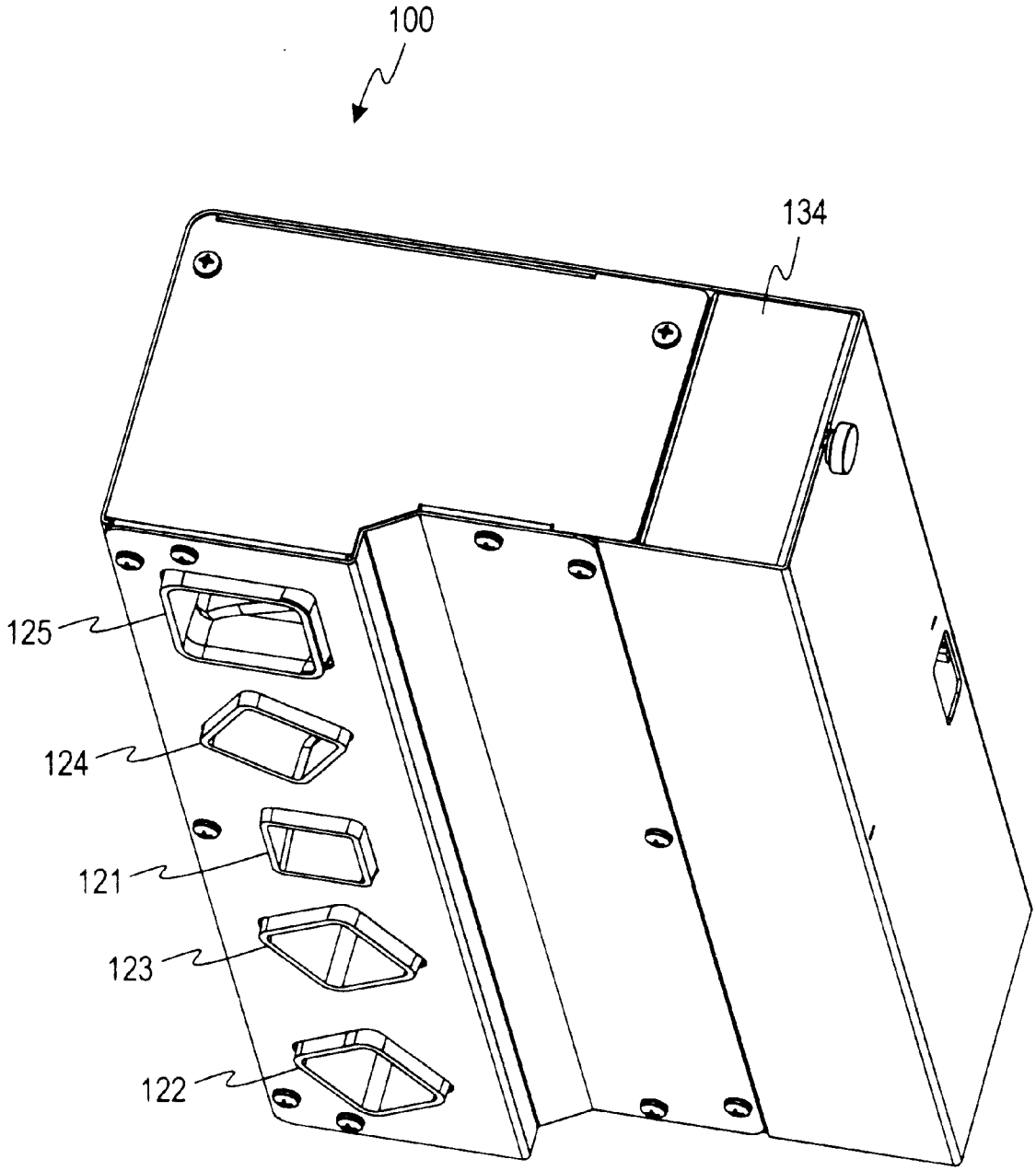
FIG. 5 is a perspective view of a cash till manifold having a sixth coin bin showing the outlets according to an embodiment of the present invention

Referring specifically to FIG. 4 and 5, the manifold 100 includes six inlets 101–106 that receive sorted coins exiting from the coin sorter system 10. For example, when manifold 100 is used with the United States coins set, inlet 101 receives dimes, inlet 102 receives pennies, inlet 103 receives nickels, inlet 104 receives quarters, inlet 105 receives dollars, and inlet 106 receives half-dollars. The coins are discharged from the manifold 100 though the corresponding outlets 121–125. The outlets 121–125 are generally aligned along a straight line to discharge coins in the compartments of a cash till.

Figure 6:
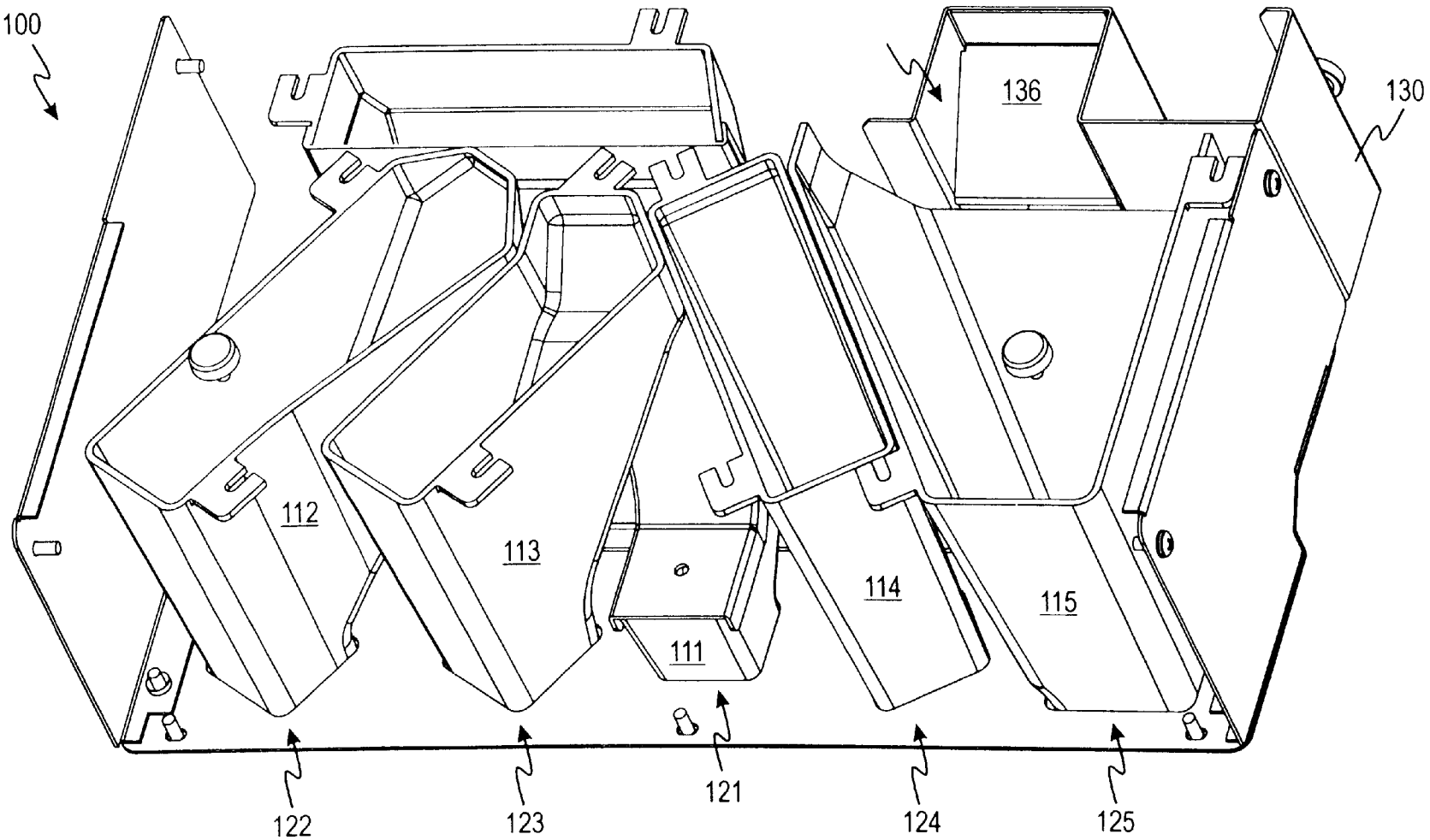
FIG. 6 is a perspective view of a cash till manifold with a diverter in place according to an embodiment of the present invention.
Figure 7:
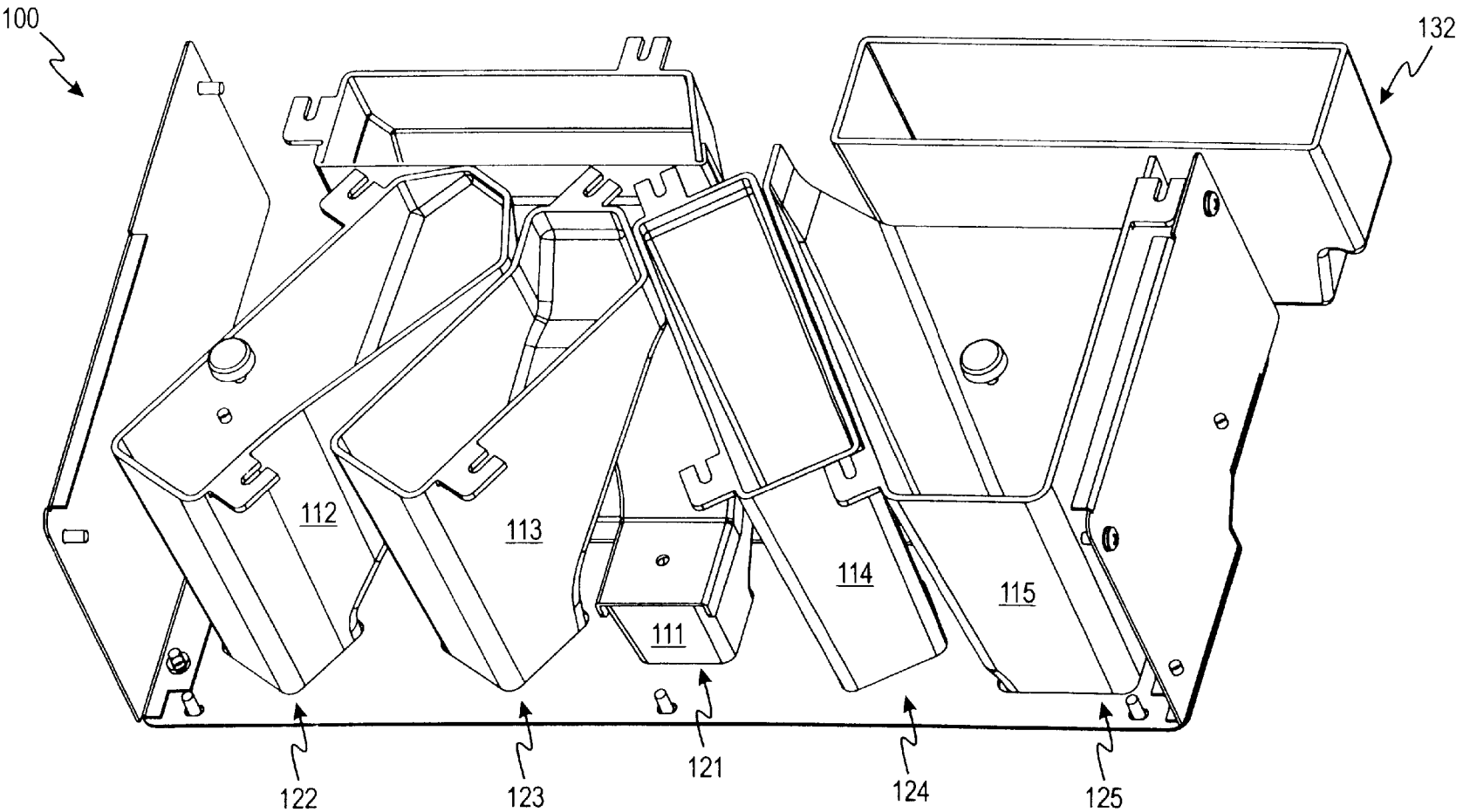
FIG. 7 is a perspective view of a cash till manifold with a six coin bin in place according to an embodiment of the present invention.
Figure 8:
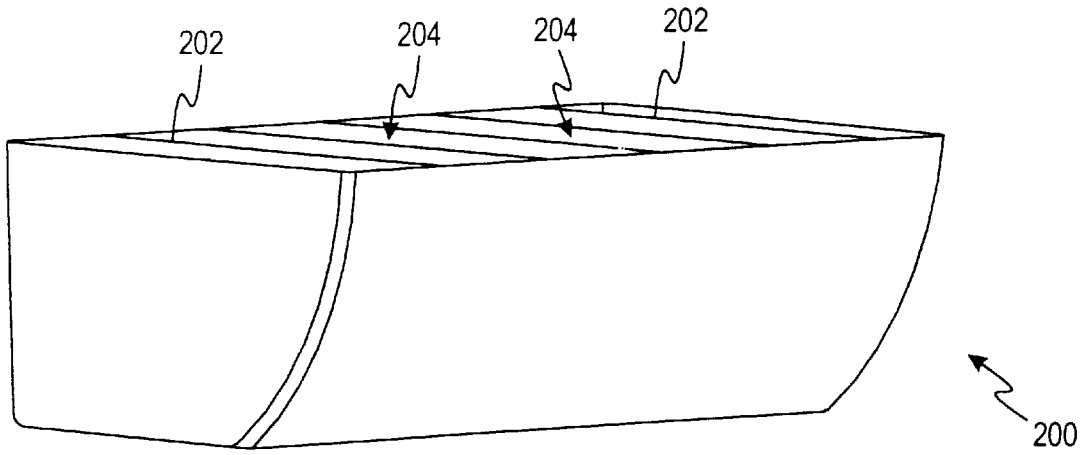
FIG. 8 is a perspective view of a segmental output receptacle according to an embodiment of the present invention.
Figure 9:
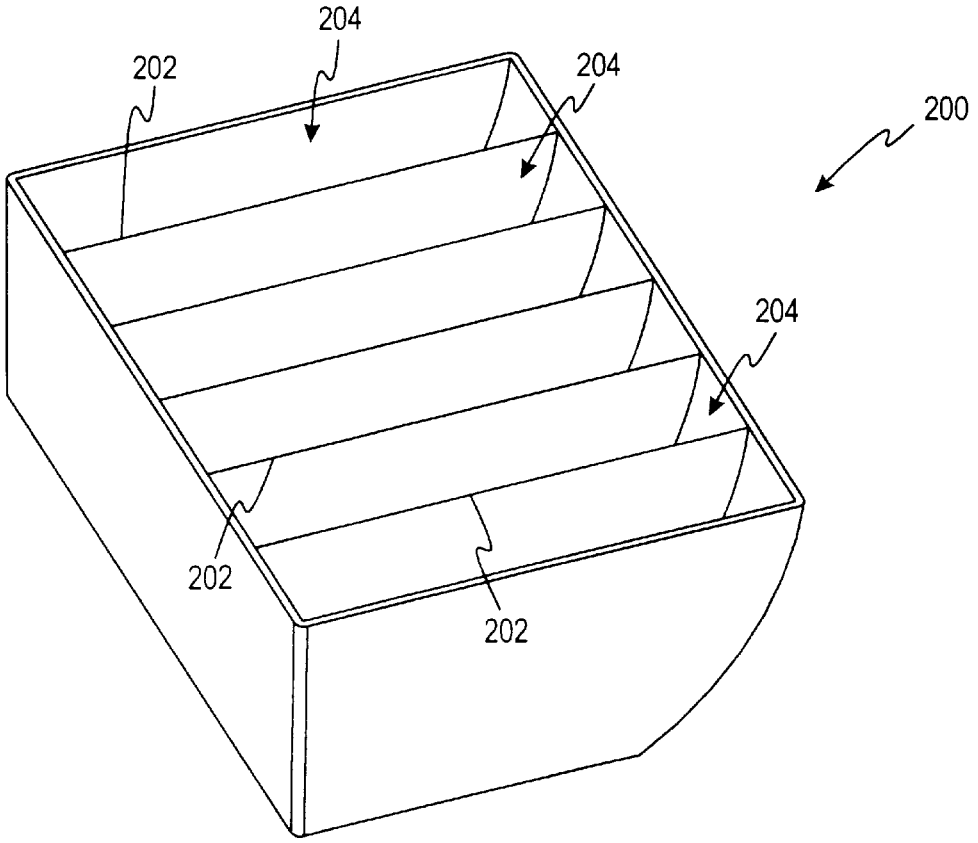
FIG. 9 is another perspective view of a segmental output receptacle according to an embodiment of the present invention.
Figure 10:
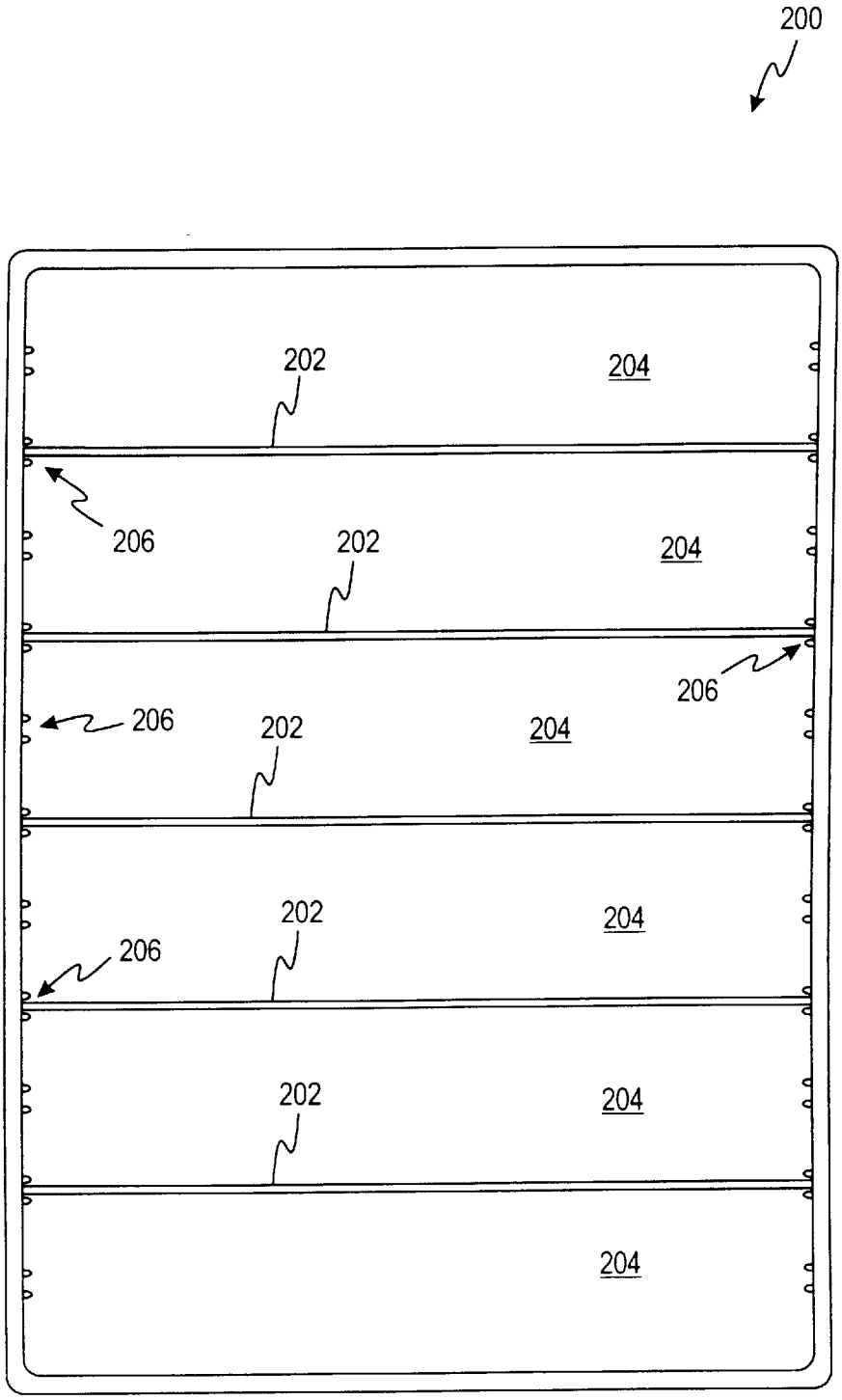
FIG. 10 is a top view of a segmental output receptacle according to an embodiment of the present invention.
Figure 11:
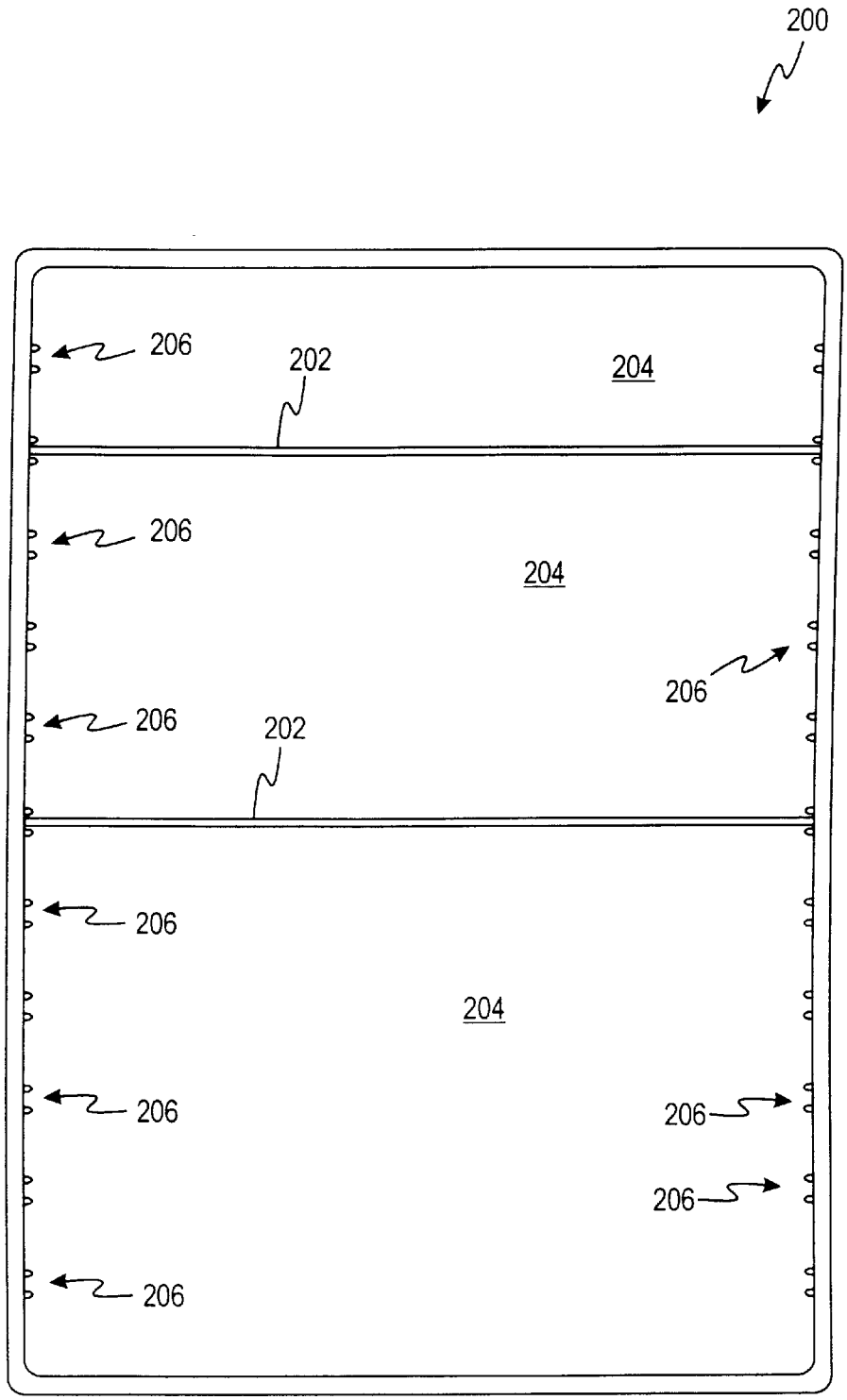
FIG. 11 is another top view of a segmental output receptacle according to an embodiment of the present invention.

FIGS. 6 and 7 illustrate the internal structure of the manifold 100. To place the coins in ascending value in a till 30, it is necessary to rearrange the flow of these coins along their respective coin paths 111–115. Accordingly, from the inlets 101–106, the coins travel down particular coin paths 111–115 which lead to five outlets 121–125. Using the United States coin set as an example, the dimes which enter inlet 101 are transported down path 111 to outlet 121. Pennies enter inlet 102 and travel down path 112 to outlet 122. Nickels enter inlet 103 and travel down path 113 to outlet 123. Quarters enter inlet 104 and travel down path 114 to outlet 124. Dollar coins enter inlet 105 and travel down path 115 to outlet 125.

There are two options for the half-dollar coins. The manifold 100 may be equipped with a diverter 130 (FIG. 6) or a coin bin 132 (FIG. 7) for processing the coin with the largest diameter (e.g. the half-dollar coin). The function of the diverter 130 is to group the coins entering inlet 106 with those coins entering inlet 105 so that those coins are collectively discharged from the manifold 100 into the fifth compartment of the cash till. The function of the coin bin 132 is to receive and hold those coins entering inlet 106 thus segregating all six coin denominations. The diverter 130 and the coin bin 132 are interchangeable. The manifold 100 contains a slot 134 (FIGS. 4 and 5) located on the side of the manifold 100 to receive the diverter 130 and the coin bin 132. The slot 134 is designed to allow the diverter 130 and the coin bin 132 to readily side in and out of the manifold 200 so that the diverter 130 can quickly be swapped with the coin bin 132, or vice versa.

When the manifold 100 is equipped with the diverter 130, coins entering inlet 106 are deflected off of angled surface 136 of the diverter 130 into path 115. Thus, those coins entering inlet 106 are discharged though outlet 125 along with the other coin denomination entering inlet 105 passing through path 115 and exiting through outlet 125. For example in the United States coins set, the manifold 100 equipped with diverter 130 would discharge dollar and half-dollar coins though outlet 125.

When the manifold 100 is equipped with the coin bin 132, the coin denomination having the largest diameter is allowed to fall though inlet 105 into the coin bin 132. For example, in the United States coin set, dollar coins would be discharged though the outlet 125 and half-dollar coins would be discharged into the coin bin 132. Whether an operator of the coin sorting system 10 decides to use the diverter 130 or the coin bin 132 with the manifold 100 would be a function of the types of coins encountered by the operator. For example, an operator who experiences a low volume of U.S. dollars and half-dollars may not require the separation of dollar and half-dollar coins. However, other users in other environments may find that the segregation of dollar and half-dollar coins is desirable. A retailer in Canada, where the largest diameter coins are the dollar coin and the two-dollar coin, might find the implementation of the coin bin 132 in the manifold 100 to be useful.

To summarize, the coin sorter system 10 is equipped with the manifold 100 and also possibly the structure 50 to elevate the coin sorter system 10 if needed. An operator can dump the coins from the cash till 30 directly into coin sorter system 10 through the conversion device 40. The cash till 30 can be inserted into the structure 50 which properly aligns the cash till 30 under the manifold 100. Depending on the desired sorting, the operator may either place the diverter 130 or the sixth coin bin 132 into the slot 134 of the manifold 100. The operator then turns on the coin sorter system 10 and the coins are sorted and distributed into the till 30, and the sixth coin bin 132 if that option was selected. This results in a very efficient procedure by which retail cash register operators (e.g. a grocery store clerk) inserts the entire day's worth of coins directly from the cash till 30 into the conversion device 40, instructs the coin sorter system 10 to begin sorting which returns the coins to the till, and reads the value of the counted coins from the display 20 of the coin sorter system 10 to assist in verifying the amounts received in the till 30 during the day. This saves the operator from having to count each of the coins present in the till by hand. Likewise, the use of the coin sorter system 10 with the manifold 100 is also helpful at the beginning of the day when an operator takes a given amount of money in currency and coins to the cash register and must determine the initial starting amount present in the cash till 30.

In an alternative embodiment of the coin sorting system 10, an operator may decide that the coin bins 15 are not needed and, instead, the sorted coins must be directed into a segmental output receptacle 200. FIGS. 8–11 illustrate embodiments of a segmental output receptacle 200 for the coin sorting system 10. The segmental output receptacle 200 is customizable to serve the particular application of the user. The segmental output receptacle 200 is placed under the coin sorter system 10 so that the segmental output receptacle 200 collects coins discharged from the coin sorter 10.

The illustrated embodiment of the segmental output receptacle 200 has five dividers 202 creating six compartments 204 corresponding to the six denominations of coins in the United States and Canadian coin sets. The dividers 202 fit within any of the slots 206. In alternative embodiments of the segmental output receptacle 200, there may be any number of slots 206 to enable the creation of compartments 204 of a variety of sizes. Any combination of dividers 202 to slots 206 can be used to tailor the segmental output receptacles to the particular needs of the user. For example, vending machine operators that only deal in nickels, dimes, and quarters may desire to segment the output receptacle 200 into three compartments 204 by placing dividers 202 into the second and forth slots 206. Another vending machine operator may primarily deal with quarters and only a small quantity of nickels and dimes. Accordingly, that operator may place two dividers 202 in the first and seconds slots 206 thus creating two small compartments 204 for the dimes and nickels, respectively, and a single large compartment 204 for the quarters. In other applications, an operator may simply want to know the aggregate value of the coins without having the coins segregated. In that situation, the operator would remove all of the dividers 202 from the segmental output receptacle 200 thus creating a single compartment 204 for the counted coins.

Figure 12:
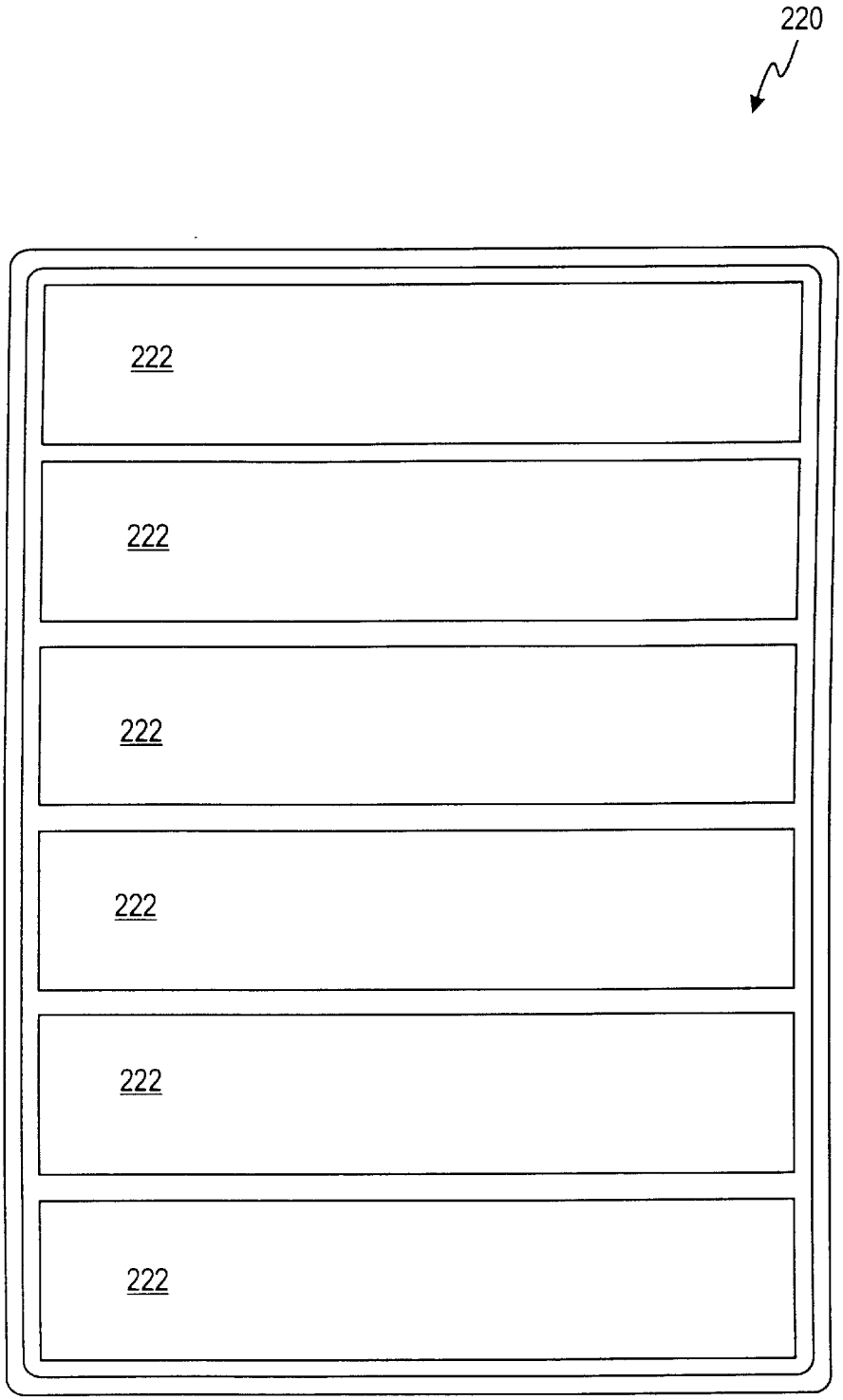
FIG. 12 is a top view of a segmental output receptacle according to an alternative embodiment of the present invention.
Figure 13:
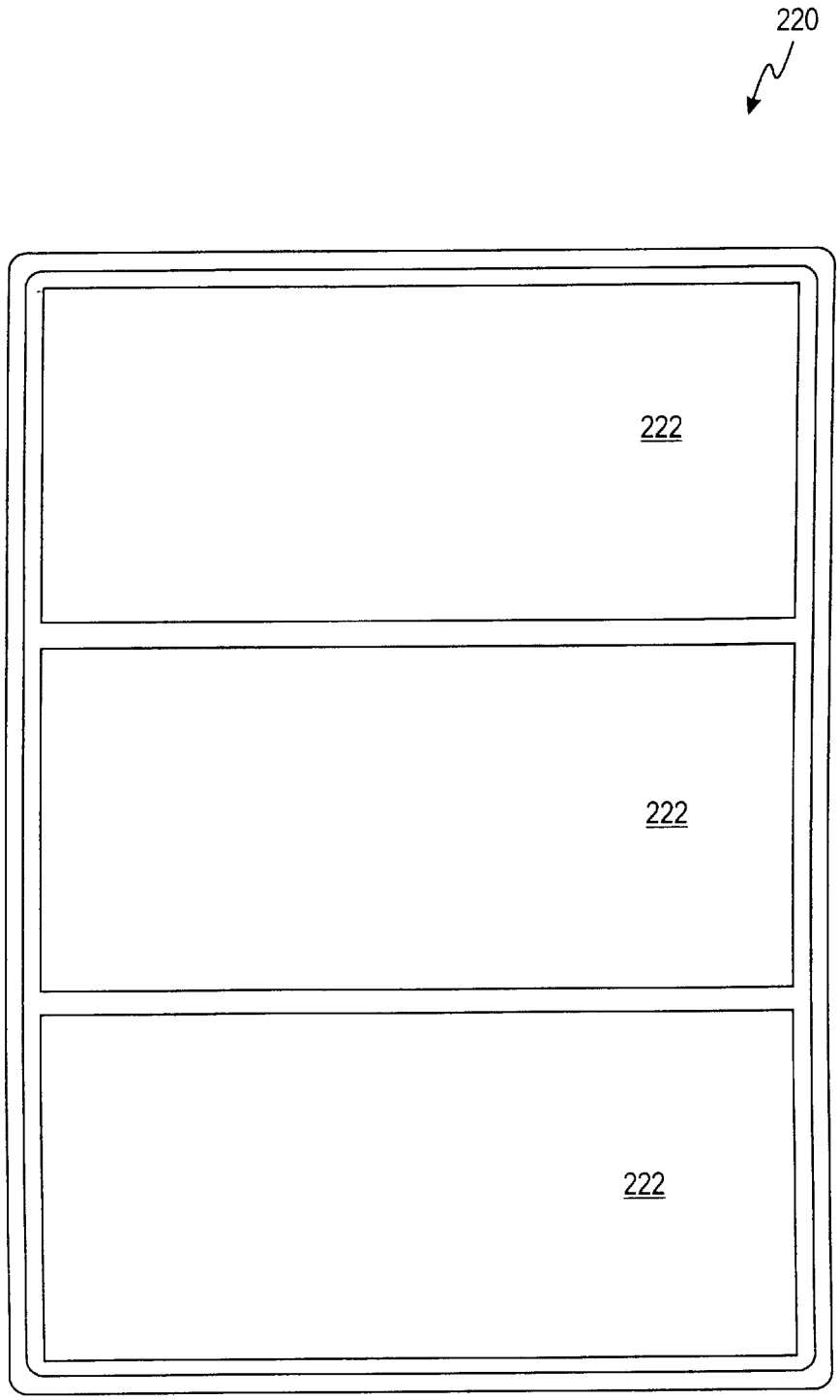
FIG. 13 is another top view of a segmental output receptacle according to an alternative embodiment of the present invention.

Referring to FIGS. 12 and 13, in another alternative embodiment of the segmental output receptacle 220, various sized containers 222 are used rather than diverters 202 to create the compartments for the processed coins. The containers 222 are preferably rectangular in shape to fit squarely within the segmental output receptacle 220. In one embodiment illustrated in FIG. 12, the output receptacle 220 can accommodate six containers 222 corresponding to the six denominations of coins in the United States and Canadian coin sets. In such an embodiment, each of the containers has an equal width. In other alternative embodiments, the containers can have any width; however, it is preferable that the combined width of the containers used approximately equals the width of the output receptacle 200 so that the containers 210 fit squarely within the output receptacle 200. Such an embodiment is illustrated in FIG. 13 wherein the segmental output receptacle 220 has three containers 222 of substantially equal width. Each of the containers 222 is preferably readily removable so that the operator can individually remove each of the containers 222 from the segmental output receptacle 220 in order to empty or replace the containers 222. Any combination of the containers 222 can be used to tailor the segmental output receptacle 220 to the needs of the individual operator.

In still another alternative embodiment, the output receptacle contains coin bags rather than compartments 204 or containers 222. In such an embodiment, the output receptacle is equipped with brackets to hold as many as six or as few as one coin bag in place.

In another alternative embodiment of the coin sorting system 300, an operator may decide is necessary to package or bag coins. When packaging coins, a predetermined number of coins are stacked within a coin package which consists of hollow cylindrical package having an inner diameter which is substantially equal to the diameter of the coin denomination to be packaged. Accordingly, there are different sized coin packages for the different denominations of coins.

Figure 14:
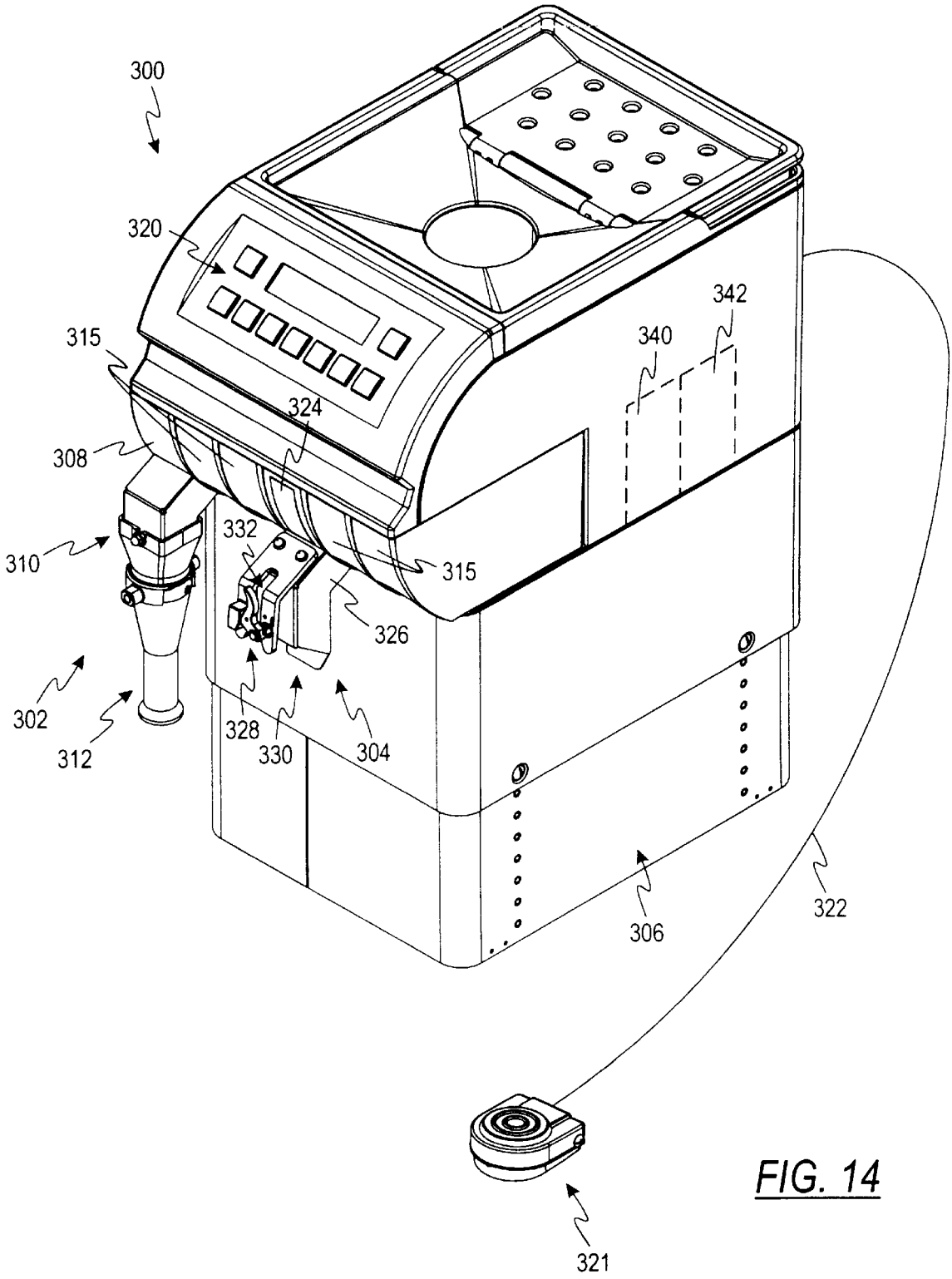
FIG. 14 is a perspective view of a coin sorter system equipped with a packaging device and a bagging device according to an alternative embodiment of the present invention.

FIG. 14 illustrates an embodiment of a coin sorter system 300 that is capable of packaging or bagging coins. In order to package or bag coins, the coin sorter system 300 is equipped with a packaging device 302 and a bagging device 304. In the illustrated embodiment, the coin sorting system 300 rests on an adjustable riser 306. The adjustable riser 306 is used to vary the height of the coin sorting system 300 during the packaging process so the operator has enough room to insert coin packages and remove stacks of packaged coins from the wrapping device 302. During the bagging process, it is preferable to adjust the height of the riser 306 so that the coin bag(s) is substantially standing upright while the bottom of the coin bag(s) rests upon a surface rather than hanging from the bagging device 304. The height of the adjustable riser 306 is varied to accommodate different sized bags. If the bag(s) were allowed to simply hang from the bagging device 304 without the bottom portion of the bag(s) being supported, the weight of the coins collected in the bag(s) could cause the coin sorting system 300 to topple over. The coin wrapping device 302 comprises a bin 308, a mount 310, and a coin stacking/packaging tube 312. The coin bin 308 is a modified coin bin 315 which was previously represented by reference number 15 in conjunction with other embodiments of the coin sorting system 300. Because the coin bin 308 is similar to coin bin 315, the packaging device 302 can be easily swapped with any of the coin bins 15 of the coin sorting system 10 (FIG. 1) or the coin bins 315 of the sorting system 300 (FIG. 14). The coin bin 308 has a downwardly sloping interior bottom surface (not shown) to direct the coins, under the force of gravity, towards the mount 310. The mount 310 connects the bin 308 and the coin stacking/packaging tube 312. The mount 310 is fixedly attached to the coin bin 308. Sorted coins are directed from the coin bin 308 through the mount 306 into the coin stacking/packaging tube 312.

Prior to and during the actual operation of the coin sorting system 300, a coin package is held within the coin stacking/packaging tube 312 by the operator. The coins flowing into the coin stacking/packaging tube 312 are aligned and then stacked within the coin package. The diameters of the coin stacking/packaging tube 312 and the diameter of the coin packages are dependent on the diameter of the denomination of coins to be packaged. Hence, a different sized coin stacking/packaging tube 312 is used for each coin denomination. The coin stacking/packaging tube 312 is readily detachable from the mount 310 so that different sized coin stacking/packaging tubes 312 can be used with each coin packaging device 302. In an alternative embodiment, each coin stacking/packaging tube 312 is color-coded to correspond to each coin package for the respective coin denominations.

To summarize the operation of the coin sorting system 300, the operator fills the device with coins and then holds an empty coin package within the coin stacking/packaging tube 312. Once the coin sorting system 300 is started, pursuant to a preprogrammed mode of operation, a predetermined number of coins are stacked within the coin package held inside the coin stacking/packaging tube 312. The system 300 then suspends operation while the operator removes the packaged coins from the coin stacking/packaging tube 308 and then inserts an empty coin package. The process is repeated until all of the coins in the batch are packaged.

Depending on the particular application, the operator may use the wrapping device 302 in conjunction with the bins 315 so that the coins are sorted and one coin denomination is also packaged. Alternatively, an operator can package coins already sorted by inputting into the coin sorting system 300 only one coin denomination. In another alternative embodiment, the coin sorting system 300 can be equipped with up to six packaging devices 302 so that up to six denominations of coins are wrapped.

As illustrated in FIG. 14, the coin sorter system 300 may also include a foot pedal 321 to aid the operation of the coin sorter system 300. The foot pedal is connected to the coin sorter system 300 via a cable 322 though a suitable communications port (not shown). Pursuant to a preprogrammed mode of operation, the coin sorting system 300 suspends operation after a predetermined number of coins are delivered to the packaging device 302. The operator may then use the foot pedal 321 to restart the machine after a package of coins is removed from the coin stacking/packaging tube 312 and an empty coin package is inserted. The pedal 321 frees the operator's hands for manipulating the coin packages and the packaged coins which allows coins to be processed more quickly. The foot peddle 321 is a time saving alternative to using the control panel 320.

The foot pedal 321 may also be used in a similar manner in conjunction with coin bagging. The bagging device 304 includes a coin bin 324 attached to a bag mount 326. The bag mount 326 provides a platform for attaching a bag clamping mechanism 328. The bag mount also has an outlet 330 through which processed coins are discharged. The coin bin 324 is a modified coin bin 315 previously discussed in conjunction with other embodiments of the coin sorting system 300. Because the coin bin 324 is similar to coin bin 315, the bagging device 304 can be easily swapped with any of the coin bins 15 of the coin sorting system 10 (FIG. 1) or the coin bins 315 of the sorting system 300 (FIG. 14). The coin bin 324 has a downwardly sloping interior bottom surface (not shown) to direct the coins, under the force of gravity, towards the outlet 330. The mount 326 is fixedly attached to the coin bin 324. Processed coins are directed from the coin bin 324 through the outlet 330 into a bag attached to the bagging device 304.

The bag mount 326 includes a bag clamping mechanism 328 to securely attach a coin bag to the bagging device 304. The bag clamping mechanism 328 allows a coin bag to be attached and removed with ease. In the illustrated embodiment, the bag mount 326 may include a grooved region 332 which receives a corresponding tongue (not shown) on the bag clamping mechanism 328.

Depending on the application, coins are bagged in a variety of manners. In one embodiment, the coin sorter system 300 is equipped with six bagging devices 304 so that a batch of mixed coins is sorted into six coin bags corresponding to six denominations of coins. In an alternative embodiment, only one coin denomination is input into a coin sorter system 300 which is equipped with one bagging device 304. In such an embodiment, a predetermined number of coins are discharged into one coin bag. The coin sorted system 300 suspends operation when each bag is full. The operator then removes the filled coin bag and attaches an empty bag to the bagging device 304. This process is repeated until the entire batch of coins is bagged or otherwise processed. The foot pedal 321 may also be implemented to restart the coin sorting system 300 in order to expedite the process. In other alternative embodiments, any combination of bagging devices 304 and bins 315 may be used.

In an alternative embodiment, the coin sorting system 300 is capable of sorting up to eight different denominations of coins. Such a coin sorter system is disclosed by commonly-owned U.S. Pat. No. 5,997,395 entitled "High Speed Coin Sorter Having a Reduced Size," previously incorporated herein by reference above. The coin sorting system 300 capable of sorting up to eight coin denominations has coin bins 340, 342 to hold the seventh and eighth coin denominations. The packaging device 302 and bagging device 304 may also be used in conjunction with the coin sorting system 300 which is cable of sorting up to eight coin denominations. In such an embodiment, the coin sorting system is capable of packaging or bagging as few as one or as many as eight different denominations of coins at one time. The seventh and eighth coin bins 340, 342 may be modified in a manner similar to coin bins 315 to accommodate the packaging and bagging devices.

While the invention is susceptible to various modifications and alternative forms, specific embodiment thereof have been shown by way of example in the drawings and will be described in detail. It should be understood, however, that it is not intended to limit the invention to the particular forms described, but, on the contrary, the intention is to cover all modifications, equivalents, and alternatives falling within the spirit and scope of the invention as defined by the appended claims.

What is claimed is:

1. A manifold for a coin sorting system that sorts a plurality of coins of mixed denominations, the manifold adapted to direct coins from the coin sorting system to a cash till, the manifold comprising:

a structure having a plurality of coin paths, the coins paths being adapted to receive sorted coins from the coin sorting system, less than all of the plurality of the paths being adapted to distribute the coins to a cash till; and at least one coin compartment adapted to hold coins received from one of the plurality coin paths.

2. The manifold of claim 1 wherein the plurality of coin paths comprises six coin paths.

3. The manifold of claim 2 wherein the six coin paths comprise five permanent coin paths and one adjustable coins path, the five permanent coin paths having an inlet and a corresponding outlet, the outlets being generally aligned along a straight line.

4. The manifold of claim 3 wherein the six coin paths receive coins sorted in order of diameter size, and wherein the five permanent coin paths distribute the coins to a cash till in increasing order of denominational value.

5. The manifold of claim 1 wherein the at least one coin compartment receives the coin denomination having the largest diameter.

6. A manifold for a coin sorting system that sorts a plurality of coins of mixed denominations, the manifold adapted to direct coins from the coin sorting system to a cash till having multiple coin compartments, the manifold comprising:

six inlets adapted to receive coins of six denominations from a coin sorter;

five permanent outlets corresponding to five of the six inlets, the five permanent outlets adapted to discharge coins into the coin compartments of the cash till;

an adjustable slot region adapted to receive coins from one of the six inlets, the adjustable slot region adapted to receive a coin bin for receiving and holding coins, the adjustable slot region being adapted to receive a diverter for directing coins to one of the five permanent outlets.

7. The manifold of claim 6 wherein the manifold further comprises a top surface, a bottom surface, and a side surface, wherein the six inlets inlet are disposed in the top surface of the manifold and the five permanent outlets are disposed in the bottom surface of the manifold, the five permanent outlets being generally aligned along a straight line.

8. The manifold of claim 7 wherein the adjustable slot region is disposed within the side surface of the manifold.

9. The manifold of claim 6 in combination with the diverter, the diverter further comprising an angled surface.

10. The manifold of claim 6 in combination with the diverter, wherein the diverter directs the coin denomination having the largest diameter.

11. The manifold of claim 6 in combination with the coin bin, wherein the coin bin receives and holds the coin denomination having the largest diameter.

12. The manifold of claim 6 wherein the six inlets receive sorted coins in order of increasing size of diameter, and wherein the five permanent outlets discharge coins in order of increasing denomination value.

13. A coin sorting system for sorting mixed coins of six denominations, wherein each of the six denominations has different sized diameters, and wherein the coin sorting system discharges the coins into a cash till having five coin receptacles, the coin sorting system comprising:

a rotating disk for imparting motion to said coins;

a structure for sorting the coins in communication with the rotating disk to sort the coins by denomination, the structure providing six coin exit channels for sorting and discharging sorted coins of six denominations, a manifold adapted to receive the sorted coins from the structure, the manifold having six inlets for receiving coins from a corresponding one of the six coin exit channels, the manifold having five permanent outlets adapted to discharge coins into the cash till, and one adjustable slot region, the adjustable slot region being adapted to receive a coin bin for receiving and holding coins, the adjustable slot region being adapted to receive a diverter for directing coins to one of the permanents outlets.

14. The coin sorting system of claim 13 further comprising a platform to receive the cash till, the platform adapted to align the receptacles of the cash till with the corresponding permanent outlets of the manifold.

15. The coin sorting system of claim 13 wherein the manifold further comprises a top surface, a bottom surface, and a side surface, wherein the six inlets are disposed in the top surface of the manifold and the five permanent outlets are disposed in the bottom surface of the manifold, the five permanent outlets being generally aligned along a straight line.

16. The coin sorting system of claim 15 wherein the adjustable slot region is disposed within the side surface of the manifold.

17. The coin sorting system of claim 13 in combination with the diverter, the diverter further comprising an angled surface.

18. The coin sorting system of claim 13 in combination with the diverter, wherein the diverted directs the coin denomination having the largest diameter.

19. The coin sorting system of claim 13 in combination with the coins bin, wherein the coin bin receives and holds the coin denomination having the largest diameter.

20. The coin sorting system of claim 13 wherein the six inlets receives sorted coins in order of increasing size of diameter, and wherein the five permanent outlets discharge coins in order of increasing denomination value.

* * * * *

UNITED STATES PATENT AND TRADEMARK OFFICE

CERTIFICATE OF CORRECTION

PATENT NO. : 6,196,913 B1
DATED : March 6, 2001
INVENTOR(S) : Joseph J. Geib et al.

It is certified that error appears in the above-identified patent and that said Letters Patent is hereby corrected as shown below:

Title page,
Item [74], *Attorney, Agent, or Firm*, delete "Cummins-Allison Corp." and insert -- Jenkens & Gilchrist --.

Signed and Sealed this

Sixteenth Day of August, 2005

JON W. DUDAS
*Director of the United States Patent and Trademark Office*